United States Patent [19]

Bessey

[11] Patent Number: 4,790,888

[45] Date of Patent: Dec. 13, 1988

[54] STOP-OFF COMPOSITION

[75] Inventor: Charles M. Bessey, Plymouth, Mich.

[73] Assignee: Kolene Corporation, Mich.

[21] Appl. No.: 158,688

[22] Filed: Feb. 22, 1988

Related U.S. Application Data

[62] Division of Ser. No. 924,294, Oct. 22, 1986, Pat. No. 4,746,376.

[51] Int. Cl.[4] ..... B23K 35/24

[52] U.S. Cl. ..... 148/28; 148/23; 148/26

[58] Field of Search ..... 148/23, 24, 26, 27, 148/28

[56] References Cited

U.S. PATENT DOCUMENTS 3,501,354 3/1970 DeLong ..... 148/26

*Primary Examiner*—Peter D. Rosenberg

[57] ABSTRACT

A method and composition for stopping-off nitrogen and/or carbon diffusion into metal surfaces. The composition, which is a mixture of a refractory material selected from the group of zirconium and aluminosilicate, sodium silicofluoride and sodium silicate, is coated onto the metal surface where diffusion is to be prevented. The mixture is cured and the metal part is subjected to elevated temperatures for carburizing, nitriding, or carbonitriding. The coating prevents nitrogen and/or carbon diffusion at the coated area. After treatment the coating is removed.

7 Claims, No Drawings

STOP-OFF COMPOSITION

CROSS REFERENCE TO RELATED APPLICATION

This is a divisional of application Ser. No. 924,294, filed Oct. 22, 1986, now U.S. Pat. No. 4,746,376.

SUMMARY OF THE INVENTION

According to the present invention, a method and composition for preventing nitrogen, carbon or oxygen, singly or in combination from diffusing into the surface of a metal at elevated temperatures is provided. An air setting aqueous mixture of refractory oxides with a modifier and silicate binders, is selectively coated onto the surface of a metal work piece where said surface is to be free of such diffusion. The solution is allowed to cure at room temperature, and the work piece is then treated at elevated temperatures in the desired medium to produce nitrogen and/or carbon diffusion on the surfaces which have not been coated. Thereafter, the remaining coating residuals are removed by conventional means.

BACKGROUND OF THE INVENTION

Frequently metal work pieces, especially steel and other ferrous metal work pieces, which have surfaces that are to be subjected to wear by friction, abrasion, rolling loads, etc., are subjected to thermal treatments in which carbon and/or nitrogen is thermochemically diffused into the surface of the article to provide a case that is more abrasion and wear resistant than the underlying original metal. Such processes are called nitriding, carburizing, and carbonitriding. These processes take place at elevated temperatures varying from as low as about 950° F. for nitriding to as high as 1700° F. and higher for carburizing. The treatments may take place in gaseous atmospheres, fused salts, vacuum, fluidized beds, or in a granular packed medium. However the process is carried out, its function and purpose is to provide a thin case of chemically altered material on the surface of the work piece or article being treated that is harder and more wear resistant than the starting material, by introducing carbon and/or nitrogen into the surface layer which carbon and/or nitrogen reacts with some of the material in this outer layer forming a harder more abrasion and wear resistant microstructure.

It is often desired that only certain areas or portions of the surface of certain articles or work pieces be hardened, and that the remaining portions be retained with the original microstructure and composition of the article without the addition of diffused nitrogen and/or carbon. One technique for accomplishing this is to case harden the whole piece and then remove the hardened case material, as by grinding, where the hardened case is not desired. This has many drawbacks, and it is much preferred to selectively cover surfaces where case hardening is not desired, prior to the heat treatment of said work pieces. Workers in the art have long sought an effective, efficient way of accomplishing such selective addition of nitrogen and/or carbon. Such research has usually involved the application of some material to the surface of the work piece which will act as a barrier to the diffusion of nitrogen and/or carbon into the surface at those locations where the material is applied. This has resulted in several materials and techniques for selectively applying them, often referred to as "stop-off" or "masking" materials. The characteristics of such stop-off materials includes effectiveness for blocking nitrogen and/or carbon diffusion at operating temperatures, ease of application, ease of removability, does not introduce any adverse effects on the surface where applied, and preferrably is economical, non-toxic, readily available, and will produce uniform repeatable results under similar conditions.

There have been several prior art proposals for such stop-off techniques. One such technique that is frequently used is to plate a thin coat of metal, such as copper or nickel, onto the surface where diffusion is to be prevented. These metal masks can work well as a barrier against nitrogen and/or carbon diffusion, but it is difficult to selectively apply them and expensive equipement and techniques are needed to both apply and remove the coated metals. Other techniques use various organic and inorganic materials in a variety of binders to prevent nitrogen and/or carbon diffusion, but they are difficult to apply and have not proven wholly satisfactory in use, especially when used in fused salt baths.

DESCRIPTION OF THE PREFERRED EMBODIMENTS

In the practice of carburizing, nitriding, and carbonitriding, work pieces are heated in the range of 950° F. to about 1700° F. Such carburizing, nitriding or carbonitriding can take place in fused salt baths, in gaseous atmospheres, in fluidized beds, or in packed granular carbon bearing materials, etc. The exposed surface of the work piece, which is normally iron or steel, will have the carbon and/or nitrogen diffused into the surface with the depth and characteristic resulting structure being a result of time, temperature, and nature of the medium contacting the surface of the work piece. The resulting piece will have a hardened, abrasion and wear resistant case on those surfaces exposed to the nitrogen and/or carbon sources. However, in many instances, it is desired that certain portions of the surface of the work pieces be maintained free of this hardened case and retain the softer characteristics of the original material of the work piece.

This invention comprises a stop-off which is composed of an inorganic refractory oxide of low coefficient of thermal expansion, e.g. zircon ($ZrSiO_4$) or aluminosilicate ($Al_2O_3$:$SiO_2$), with a modofier, i. e. sodium silicofluoride ($Na_2SiF_6$) and sodium silicate binders.

The coating can be applied in any of numerous ways, such as by dipping, spraying, brushing, silk screening, roll coating or extrusion. The manner of application is not critical, the important aspect being to achieve a dense uniform cured coating that completely covers the desired areas without excessive porosity or microcracks. The coating should be allowed to set or harden at room temperature for about 30 to 60 minutes before the work piece is entered into the high temperature heat treatment. After heat treatment, work pieces are typically quenched in water, oil, or salt baths, which tend to loosen or reduce the adhesion of the ceramic stop-off, and remaining residues can be easily removed with subsequent mechanical means, like wire brushing, vibratory finishing, vapor or shot blasting, etc.

The reason that the coating works so effectively as a stop-off is not completely understood. However, it is believed that a condensation reaction polymer of the refractory oxide, the silicofluoride modifier and the sodium silicate is formed, thus presenting a tough, temperature and chemical resistant ceramic polymer barrier that is impervious to the diffusion of nitrogen, carbon or oxygen, singly or in combination, into the surface of work pieces.

In formulating the coating, an aqueous mixture is formed either by starting with a dry mix of the refractory oxide, the silicofluoride modifier and sodium silicate powders (anhydrous or hydrated), and adding water, or by starting with an aqueous sodium silicate solution and adding the refractory/modifier materials to it. It has been found that while a mixture of refractory oxides and sodium silicate alone will, under ideal conditions, provide only a partial barrier to nitrogen and/or carbon diffusion, the addition of sodium silicofluoride results in a complete barrier against virtually all diffusion of nitrogen and/or carbon.

It has been found that the addition of sodium silicofluoride also allows for a wider range of mixture viscosities, and refractory oxide adjustments to be obtained and thereby achieve better control of the coverage of the surface with a dense ceramic refractory to improve barrier results with a variety of formulations for different applications and heat treating environments.

It has also been found that the ratio of $SiO_2$:$Na_2O$ in the silicate binder can be critical to the effectiveness of the stop-off capabililities of various formulated coatings. With a $SiO_2$:Na $_2$) ratio of less than 2:1, the coatings will not work effectively. However, with ratios of 2:1 up to 3.25:1 effective coatings can be produced depending upon the amount of sodium silicofluoride present in the overall mixture. The above ratio silicates being readily available commercially with solids contents of B 32 to B 51% by weight, in a variety of viscosity ranges. The preferred sodium silicate solutions are those with lower viscosities and higer solids contents, with the preferred sodium silicate powders being the hydrated, lower ratio silicates, which more rapidly dissolve in water.

It has been found that a preferred range for the constituents, in weight percentage is from about 50% to 80% refractory oxide, from about 10% to 48% sodium silicate, and from about 2% to 40% sodium silicofluoride. An especially desirable composition is, in weight percentage, about 66% zircon, about 22% sodium silicate solution (2.5:1 ratio) and about 12% sodium silicofluoride. Another especially desirable composition by weight percentage is, 53% aluminosilicate, 22% sodium silicate solution (3.2:1 ratio), and 25% sodium silicofluoride. Another preferred mixture using hydrated sodium silicate powders is: 55% zircon, 32% sodium silicofluoride and 13% sodium silicate powder (2:1 ratio), with the blended constituents being mixed with water prior to use.

EXAMPLES

A blend of fine milled zircon and sodium silicofluoride were mixed with an aqueous solution of sodium silicate, the sodium silicate having a ratio of $SiO_2$:$Na_2O$ of 2.5:1. The resulting mixture had the following composition: 66% zircon, 22% sodium silicate solution and 12% sodium silicofluoride. A select area on the surface of a medium carbon steel work piece was covered with this mixture. Another area was covered with a similar composition but without the addition of the sodium silicofluoride. This mixture had the following composition: about 74% zircon and 26 % sodium silicate solution. The coatings were allowed to dry at room temperature and then the articles were preheated at 750° F. for 30 minutes, to reduce thermal shock to the work pieces. Following this the work pieces were immersed in a fused nitriding salt bath maintained at 1075° F. for 60 minutes, quenched in an oxidizing salt bath at 750° F. and subsequently rinsed in water and wire brushed to remove the residual stop-off material.

In the unmasked portion of the work piece, nitrogen diffusion produced a normal iron nitride compound zone of B 0.00035" in depth. In the areas protected or masked with the material containing the sodium silicofluoride there was no discernable compound zone or diffused nitrogen present in solid solution. In the areas protected by the material without the sodium silicofluoride additive there was slight nitrogen diffusion creating a shallow compound zone of about 0.000035" to 0.000045" in depth.

Other tests using the above mixtures and coating techniques showed similar results in preventing nitrogen and carbon diffusion in both, gas carburizing at 1700° F. and gaseous carbonitriding at 1500° F.

Other tests using stop-off formulations with anhydrous and hydrated sodium silicate powders blended with zircon and sodium silicofluoride, which are activated by water additions; and formulations utilizing aluminosilicates, sodium silicofluoride and sodium silicate solutions,were used to coat materials in a similar manner and displayed the same results in completely preventing nitrogen diffusion in fused nitriding salt baths.

It has also been determined that sodium silicofluoride extends the pot-life of the mixture as mixed formulas, and that maintaining the mixtures at lowered temperatures (40° to 45° F.) can also significantly extend the shelf or pot-life of these mixtures.

It has also been found that minor amounts of potassium silicates and/or potassium silicofluorides can be added to the mixture to accelerate setting or curing of the applied thin coating, but these potassium compounds tend to induce detrimental microcracking in the cured coatings, so only minor amounts should be used. The exact or optimum amount for any particular application being determined by routine experimentation.

Minor or trace amounts of other constituents, such as other oxides, i. e. zirconia, alumina, titania, etc., various clays (bentonite or kaolin) or cellulose materials may be added in controlled amounts to enhance workability or to modify the characteristics of these mixtures depending upon the particular application technique, and/or the particular heat treating media that is to be employed.

What is claimed is:

1. A composition for preventing the diffusion of carbon or nitrogen into the surface of a metal at elevated temperatures comprising, an aqueous mixture of a refractory material selected from the group of zircon and aluminosilicate, sodium silicofluoride, and a sodium silicate binder.

2. The invention as defined in claim 1 wherein there is from about 50% to 80% refractory material, from 10 to 48% sodium silicate, and about 2 to 40% sodium silicofluoride.

3. The invention as defined in claim 2 wherein the refractory material is zircon.

4. The invention as defined in claim 3 wherein the zircon is about 66%, the sodium silicate is about 22% and the sodium silicofluoride is about 12%.

5. The invention as defined in claim 2, wherein the refractory material is aluminosilicate.

6. The invention as defined in claim 5 wherein the aluminosilicate is about 53%, the sodium silicate is about 22% and the sodium silicofluoride is about 25%.

7. The invention as defined in claims 2, 3, 4, 5, and 6 wherein the ratio of SiO2:Na2O in the sodium silicate is between about 2:O:1 and 3.25:1.

* * * * *